US010871172B2

(12) United States Patent
Kim et al.

(10) Patent No.: US 10,871,172 B2
(45) Date of Patent: Dec. 22, 2020

(54) FAN GUARD ASSEMBLY AND OUTDOOR UNIT HAVING THE SAME

(71) Applicant: Samsung Electronics Co., Ltd., Suwon-si (KR)

(72) Inventors: Jin-baek Kim, Hwaseong-si (KR); Yeon-je Kim, Suwon-si (KR); Seong-hyun Yoon, Seoul (KR); Yi-goo Gong, Suwon-si (KR); Je-gu Lee, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 388 days.

(21) Appl. No.: 15/482,011

(22) Filed: Apr. 7, 2017

(65) Prior Publication Data

US 2017/0343016 A1 Nov. 30, 2017

(30) Foreign Application Priority Data

May 31, 2016 (KR) ..... 10-2016-0067520

(51) Int. Cl.
*F04D 29/70* (2006.01)
*F24F 1/56* (2011.01)
(Continued)

(52) U.S. Cl.
CPC ..... *F04D 29/703* (2013.01); *F04D 19/002* (2013.01); *F04D 25/0693* (2013.01);
(Continued)

(58) Field of Classification Search
CPC .... F04D 29/703; F04D 29/325; F04D 29/329; F04D 25/0693; F04D 19/002; F24F 1/38; F24F 1/56
See application file for complete search history.

(56) References Cited

U.S. PATENT DOCUMENTS 5,097,678 A * 3/1992 Aubuchon ..... F24F 1/50 150/154
5,117,656 A * 6/1992 Keck ..... F04D 29/601 62/506

(Continued)

FOREIGN PATENT DOCUMENTS

JP 3-96700 4/1991
JP 2013-119816 6/2013

(Continued)

OTHER PUBLICATIONS

Extended European Search Report dated Jan. 26, 2018 in corresponding European Patent Application No. 17168834.4.

(Continued)

*Primary Examiner* — Brian P Wolcott
(74) *Attorney, Agent, or Firm* — Staas & Halsey LLP

(57) ABSTRACT

A fan guard assembly having an improved structure for providing improved performance and an outdoor unit having the same are provided. The fan guard assembly includes: a front panel having an outlet; and a fan guard including a hub provided at the outlet to directly fix a fan motor assembly and a rib connecting between the hub and the front panel. Further, the outdoor unit includes: a cabinet; a bell mouth provided in the cabinet; a fan guard provided at an outlet of the bell mouth; and a fan motor assembly fixed to the fan guard.

15 Claims, 10 Drawing Sheets

(51) Int. Cl.

| | |
|---|---|
| ***F04D 29/32*** | (2006.01) |
| ***F04D 19/00*** | (2006.01) |
| ***F24F 1/38*** | (2011.01) |
| ***F04D 25/06*** | (2006.01) |

(52) U.S. Cl.
CPC ..... *F04D 29/325* (2013.01); *F04D 29/329* (2013.01); *F24F 1/38* (2013.01); *F24F 1/56* (2013.01)

(56) References Cited

U.S. PATENT DOCUMENTS

| | | | | |
|---|---|---|---|---|
| 6,139,265 | A * | 10/2000 | Alizadeh | F04D 29/544 415/208.1 |
| 6,503,060 | B1 * | 1/2003 | Kamada | F04D 29/703 415/121.2 |
| 6,764,277 | B2 * | 7/2004 | Somahara | F04D 29/703 415/121.2 |
| 6,866,474 | B2 * | 3/2005 | Uselton | F04D 29/703 415/121.2 |
| 7,172,387 | B2 * | 2/2007 | Yamamoto | F04D 29/703 415/119 |
| 7,811,055 | B2 * | 10/2010 | Stommel | F01P 5/06 415/191 |
| 8,137,059 | B2 * | 3/2012 | Kim | F04D 29/703 415/119 |
| 9,347,465 | B2 * | 5/2016 | Gonzalez | F24F 1/06 |
| 9,416,982 | B2 * | 8/2016 | Kim | F24F 1/38 |
| 2004/0146395 | A1 | 7/2004 | Uselton | |
| 2005/0271529 | A1 | 12/2005 | Stommel et al. | |
| 2009/0110542 | A1 | 4/2009 | Kim et al. | |
| 2014/0154095 | A1 | 6/2014 | Gonzalez | |

FOREIGN PATENT DOCUMENTS

| | | |
|---|---|---|
| KR | 10-2009-0130670 | 12/2009 |
| KR | 20-0466110 | 4/2013 |
| KR | 10-1473875 | 12/2014 |

OTHER PUBLICATIONS

Communication pursuant to Article 94(3) EPC dated Apr. 16, 2020, in corresponding European Patent Application No. 17168834.4.

* cited by examiner

FAN GUARD ASSEMBLY AND OUTDOOR UNIT HAVING THE SAME

CROSS-REFERENCE TO RELATED APPLICATIONS

This application claims priority from Korean Patent Application No. 10-2016-0067520, filed on May 31, 2016 in the Korean Intellectual Property Office the disclosure of which is incorporated herein by reference in its entirety.

BACKGROUND OF THE INVENTION

1. Field of the Invention

Apparatuses and methods consistent with the present disclosure relate to a fan guard assembly having an improved structure for providing improved performance and an outdoor unit having the same.

2. Description of the Related Art

In general, an air conditioner is a device removing dust, and the like in the air while controlling a distribution of temperature, humidity, an air current, and the like, appropriate for human activities using a freezing cycle. Main components configuring the freezing cycle include a compressor, a condenser, an evaporator, a blower fan, and the like.

An air conditioner is referred to as a split type air conditioner when an indoor unit and an outdoor unit are installed separately and is referred to as an integrated air conditioner when the indoor unit and the outdoor unit are installed together in a single cabinet. The split type air conditioner is composed of the indoor unit having the evaporator and the fan and the outdoor unit having the compressor, the condenser, and the fan.

The outdoor unit of the split type air conditioner has a motor for rotating the fan and a motor bracket for supporting the motor. Considering a position where the motor and the motor bracket are installed in the outdoor unit, it is common that the motor and the motor bracket are installed between the condenser and the fan. Describing the flow of air in the installation structure, air introduced into an inlet sequentially passes through the condenser, the motor bracket, and the fan, and then is discharged through an outlet.

However, in a structure in which the motor and the motor bracket are provided at a suction side of the fan, a channel resistance of the suction side of the fan increases, and thus the fan performance may deteriorate. In addition, since the rigidity of the motor bracket needs to be secured due to characteristics of the motor bracket, the motor bracket should be formed as large as possible. As a result, the motor bracket cannot but increase the channel resistance. As such, the decrease in the fan performance due to the increase in the channel resistance is a direct cause of an increase in power consumption of the motor and an increase in noise.

SUMMARY OF THE INVENTION

Exemplary embodiments of the present invention overcome the above disadvantages and other disadvantages not described above. Also, the present invention is not required to overcome the disadvantages described above, and an exemplary embodiment of the present invention may not overcome any of the problems described above.

The present disclosure provides an outdoor unit capable of decreasing a flow resistance of air flowing from a blower fan.

The present disclosure also provides a fan guard assembly capable of securing rigidity for stably supporting a blower fan and a motor.

According to as aspect of the present disclosure, an outdoor unit includes: a cabinet; a bell mouth provided in the cabinet; a fan guard provided at an outlet of the bell mouth; and a fan motor assembly fixed to the fan guard.

The fan guard may include: a hub located at a center of the outlet and having the fan motor assembly fixed thereto; and a rib connecting between the hub and the cabinet.

The fan motor assembly may include: a motor fixed to the hub; and a blower fan driven by the motor.

A height of the rib may increase outwardly from the hub.

The rib may include a first end surface corresponding to a position where it is connected to the hub and a second end surface corresponding to a tip of a blade of the blower fan, the first end surface may have a height of 0.02 to 0.09 times a distance L from a center of the hub to the tip of the blade, and the second end surface may have a height of 0.04 to 0.2 times the distance L.

The rib further may include a third end surface located between the first and second end surfaces, at the same distance from the first and second end surfaces, respectively, and the third end surface may have a height of 0.03 to 0.14 times the distance L.

A cross section of the rib may have a tilt angle increasing as being far away from the hub with respect to a driving shaft of the motor.

The rib may include a first end surface corresponding to a position where it is connected to the hub and a second end surface corresponding to a tip of a blade of the blower fan, the first end surface may have a tilt angle of 10° to 30°, and the second end surface may have a tilt angle of 20° to 40°.

The rib may further include a third end surface located between the first and second end surfaces, at the same distance from the first and second end surfaces, respectively, and the third end surface may have a tilt angle of 15° to 35°.

The rib may include: a plurality of first ribs radially provided from the hub; and a plurality of second ribs spaced from the hub in a circumferential direction to be connected to the first ribs.

The plurality of first ribs may include: a first rib having a height increasing outwardly from the hub; and an auxiliary rib connecting between the second rib and the cabinet.

A tip of the first rib may be located on the same plane and a rear end of the first rib may have a height increasing toward the fan motor assembly.

A transverse section of the first rib may have a fan shape or an airfoil.

The hub may have an insertion portion into which at least a part of the motor is inserted.

The hub may have a fastening portion protruding from an outer circumferential surface of the hub, and the fastening portion may have a fastening hole fastened to the motor.

The rib may have an accommodating portion accommodating an electric wire connected to the motor.

The bell mouth may have a through hole through which the electric wire penetrates.

According to another aspect of the present disclosure, a fan guard assembly includes: a front panel having an outlet; and a fan guard including a hub provided at the outlet to directly fix a fan motor assembly and a rib connecting between the hub and the front panel.

The fan guard may have greater rigidity outwardly from the hub to support the fan motor assembly.

The front panel and the fan guard may be integrally formed.

BRIEF DESCRIPTION OF THE DRAWING FIGURES

The above and/or other aspects of the present invention will be more apparent by describing certain exemplary embodiments of the present invention with reference to the accompanying drawings, in which.

DETAILED DESCRIPTION OF THE EXEMPLARY EMBODIMENTS

Figure 1:
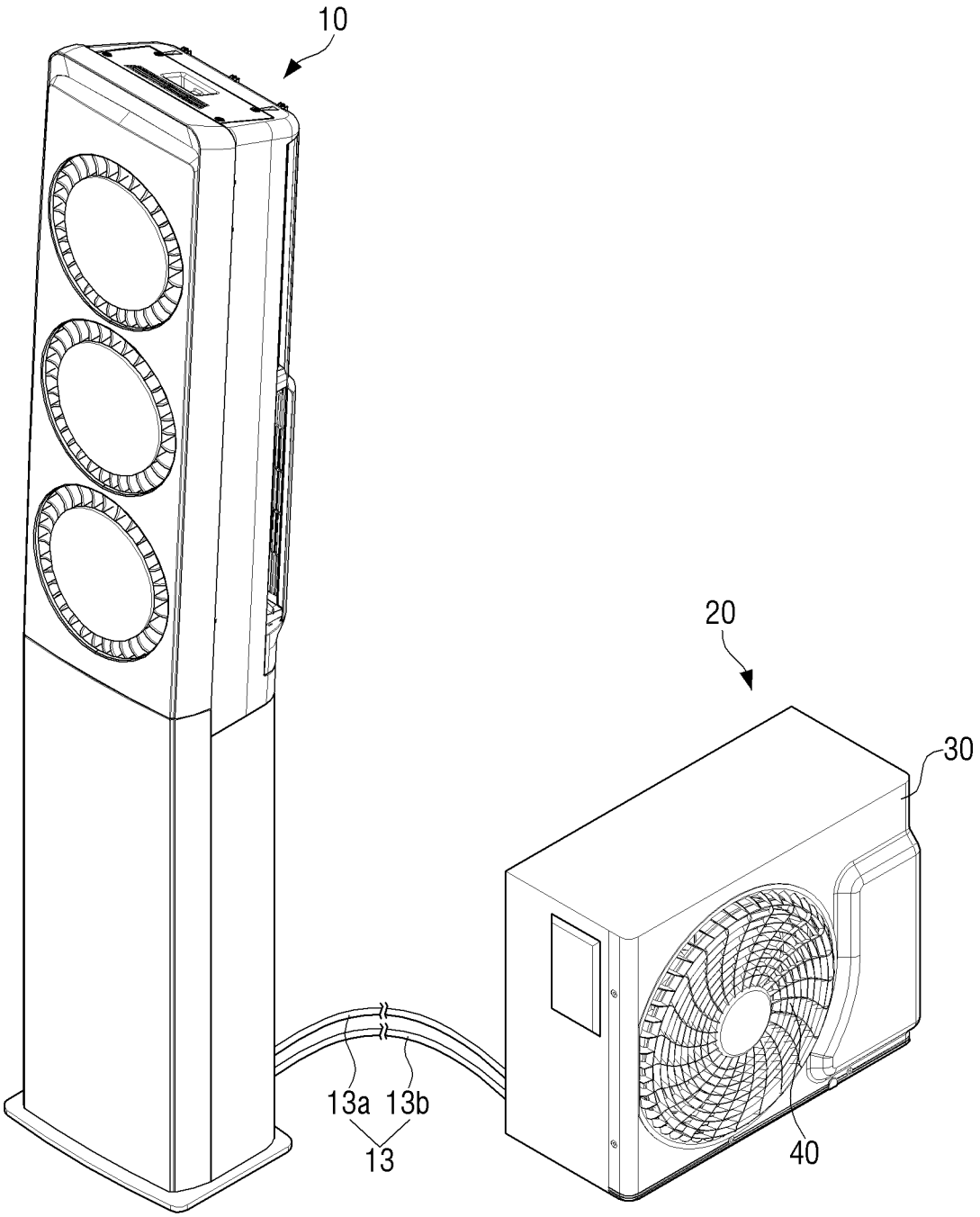
FIG. 1 is a perspective view schematically illustrating an air conditioner according to an exemplary embodiment of the present disclosure.

Although exemplary embodiments of the present disclosure have been illustrated and described, the present disclosure is not limited to the above-mentioned specific exemplary embodiment, but may be variously modified by those skilled in the art to which the present disclosure pertains without departing from the spirit and scope of the present disclosure as claimed in the claims. In addition, such modifications should also be understood to fall within the scope of the present disclosure.

Hereinafter, an exemplary embodiment of the present disclosure will be described in more detail with reference to FIGS. 1 to 10. The following exemplary embodiments will be described based on exemplary embodiments most appropriate to understand technical features of the present disclosure and the technical features of the present disclosure are not limited to the exemplary embodiments to be described below but it is illustrated that the present disclosure may be implemented like exemplary embodiments to be described.

Therefore, the present disclosure may be variously changed within the technical scope of the present disclosure in accordance with the exemplary embodiments to be described below and the changed exemplary embodiments may be considered to be included in the technical scope of the present disclosure. Further, to help understand the following exemplary embodiments, in signs described in the accompanying drawing, relevant components among components performing the same operations in each exemplary embodiment are denoted by reference numerals on the same or extending line.

FIG. 1 is a perspective view schematically illustrating an air conditioner according to an exemplary embodiment of the present disclosure. Referring to FIG. 1, an air conditioner according to an exemplary embodiment of the present disclosure includes an indoor unit 10 and an outdoor unit 20. The indoor unit 10 and the outdoor unit 20 may be connected to each other by a refrigerant pipe 13.

The refrigerant pipe 13 may include a first refrigerant pipe 13*a* and a second refrigerant pipe 13*b*. A refrigerant condensed in the outdoor unit 20 may move to the indoor unit 10 through a first refrigerant pipe 13*a*. The refrigerant exchanging heat with indoor air in the indoor unit 10 may move to the outdoor unit 20 through the second refrigerant pipe 13*b*. The refrigerant may circulate through a refrigerant pipe (not illustrated) installed in the indoor unit 10 and a refrigerant pipe (not illustrated) installed in the outdoor unit 20 through the refrigerant pipe 13.

The indoor unit 10 may discharge the air, which is heat exchanged with the refrigerant compressed and condensed in the outdoor unit 20, to the interior of a room to maintain the room temperature at an appropriate temperature. The indoor unit 10 may include an expansion valve and an evaporator. The air cooled by the refrigerant evaporated in the evaporator is discharged to the interior of a room, and thus the room air may be cooled. The indoor unit 10 may be provided with a fan assembly (not illustrated) and a diffuser assembly (not illustrated) so that the air cooled by the refrigerant may be smoothly discharged into the interior of a room.

The outdoor unit may include a cabinet 30 forming an appearance and a fan guard provided at an outlet of the cabinet 30. The inside of the cabinet 30 may be provided with a compressor, a condenser, and a blower fan. The cabinet 30 may be provided with an inlet through which external air is introduced and an outlet through which the introduced air may be discharged to the outside. The outlet may be provided with the fan guard 40 for protecting the blower fan. The compressor compresses the refrigerant, and the compressed refrigerant is introduced into the condenser to be condensed. At this time, the blower fan is driven and the external air introduced through the inlet may cool heat generated in the condenser. A construction and an operation of the outdoor unit and the indoor unit are well known in the art and thus a detailed description thereof will be omitted.

Figure 2:
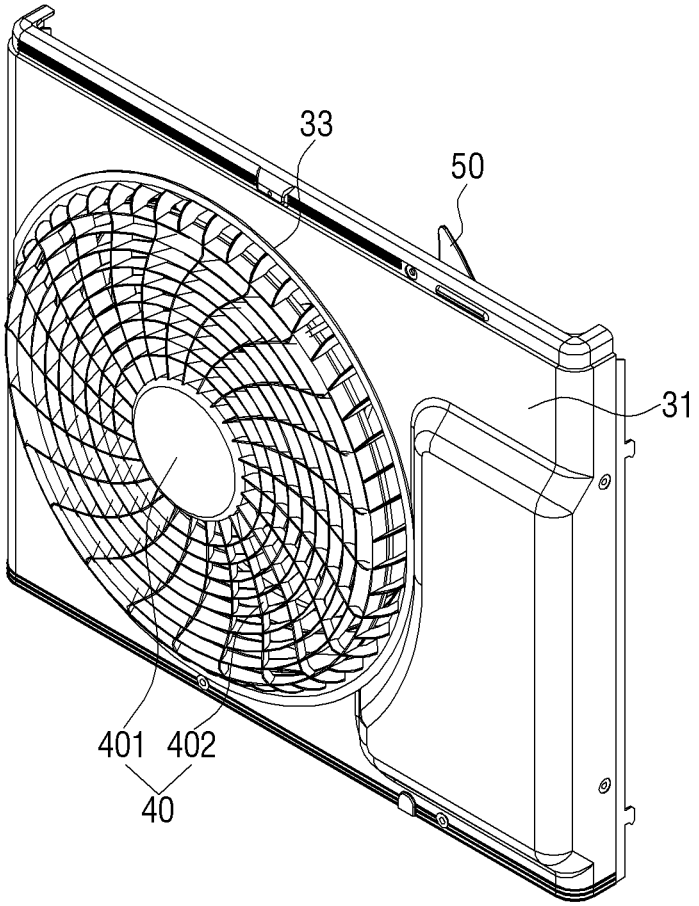
FIG. 2 is a perspective view of a fan guard assembly according to an exemplary embodiment of the present disclosure viewed from a front.
Figure 3:
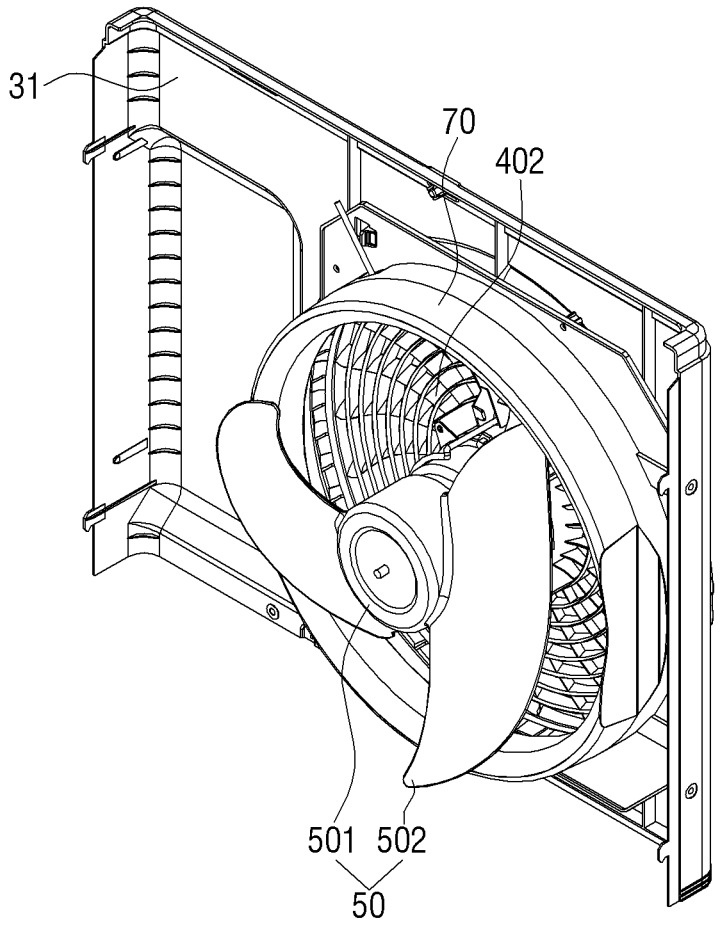
FIG. 3 is a perspective view of the fan guard assembly according to the exemplary embodiment of the present disclosure viewed from a rear.
Figure 4:
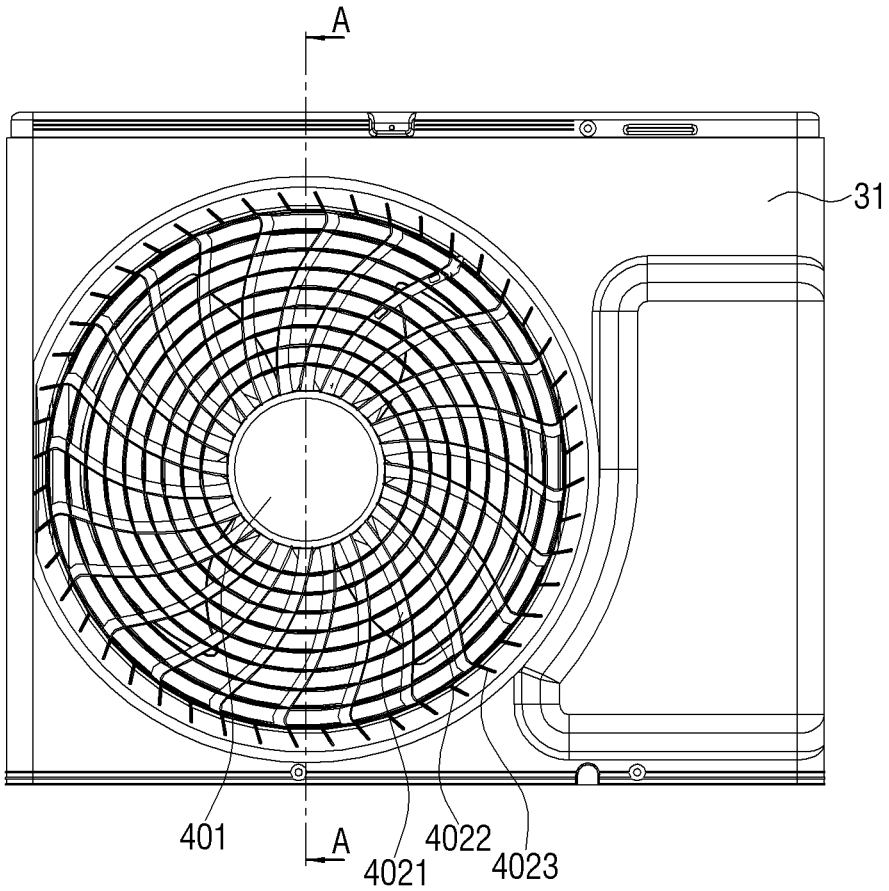
FIG. 4 is a front view of the fan guard assembly according to the exemplary embodiment of the present disclosure.
Figure 5:
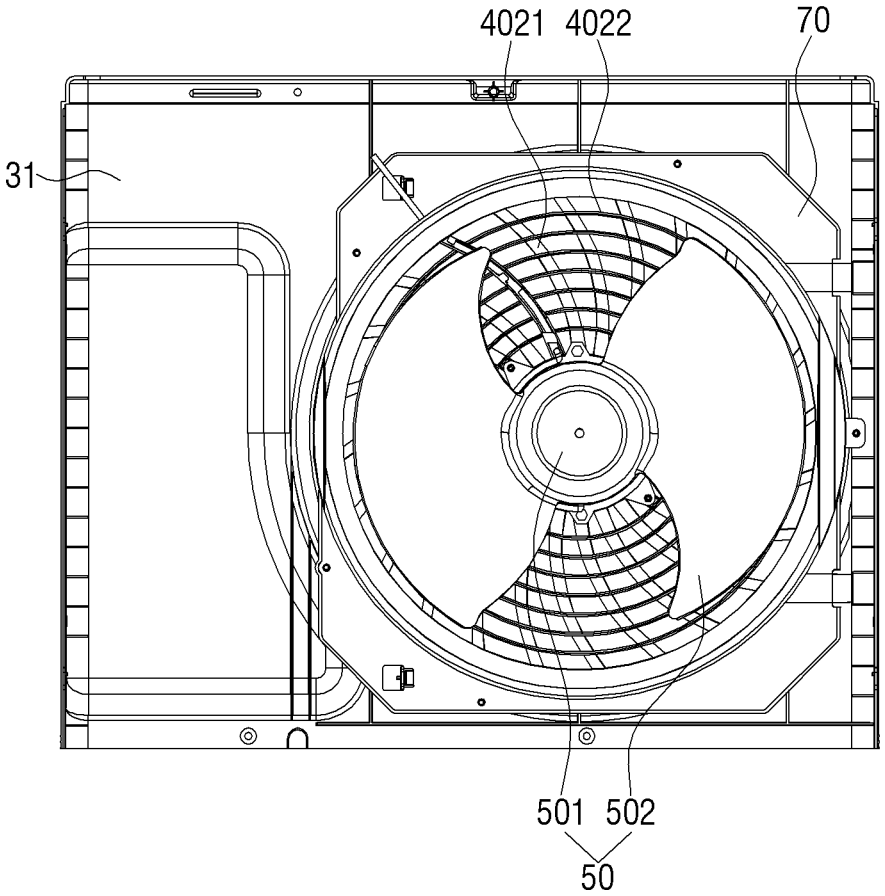
FIG. 5 is a rear view of the fan guard assembly according to the exemplary embodiment of the present disclosure.

FIG. 2 is a perspective view of a fan guard assembly according to an exemplary embodiment of the present disclosure viewed from a front and FIG. 3 is a perspective view of the fan guard assembly according to the exemplary embodiment of the present disclosure viewed from a rear. FIG. 4 is a front view of the fan guard assembly according to the exemplary embodiment of the present disclosure and FIG. 5 is a rear view of the fan guard assembly according to the exemplary embodiment of the present disclosure.

Referring to FIGS. 2 to 5, the fan guard assembly includes a front panel 31 of the cabinet and the fan guard 40 connected to the front panel 31. The front panel 31 may be provided with an outlet 33 for discharging air to the outside. The fan guard 40 may include a hub 401 provided at the outlet 33 to directly fix the fan motor assembly and a rib 402 connecting between the hub 401 and the front panel 31. The front panel 31 and the rib 402 may be integrally formed by injection molding.

Here, the fan motor assembly may include a motor 60 and a blower fan 50 driven by the motor 60. Further, the blower fan 50 includes a body 501 connected to a driving shaft 601 of the motor 60 and rotating together with the motor 60 and a blade 502 connected to an outer circumferential surface of the body 501. Here, the blower fan 50 may be provided in various shapes and structures for blowing the air introduced into the cabinet 30 to the outlet 33.

The rib 402 may include a first rib 4021 radially provided from the hub 401 and a second rib 4022 spaced from the hub in a circumferential direction and connected to the first rib 4021. Further, the rib 402 may further include an auxiliary rib 4023 connecting between the second rib 4022 located at the outermost side and the front panel 31. The first rib 4021 may be shaped to have a height increasing outwardly and the plurality of auxiliary ribs 4023 may be provided at a predetermined position so that the second rib 4022 located at the outermost side may be easily supported on the front panel 31.

For example, a transverse section of the first rib 4021 may have a fan shape or an airfoil, but the shape of the transverse section of the first rib 4021 is not limited thereto, and therefore the first rib 4021 may be changed to have cross sectional areas of various shapes. Meanwhile, the number of each rib 402 may be adjusted by a user so as to stably support the fan motor assembly. The rib 402 will be described in detail with reference to the subsequent drawings.

In addition, the fan guard assembly may further include a bell mouth 70 connected to the rear of the front panel 31. For example, the bell mouth 70 may be screwed to the front panel 31 and thus detached from the front panel 31. The bell mouth 70 is located on the outer circumference of the blower fan 50 to guide the air discharged from the blower fan 50 to the outside.

For example, the rear of the bell mouth 70 may be referred to as an inlet through which the air discharged from the blower fan 50 is introduced into the bell mouth 70 and the front of the bell mouth 70 adjacent to the rib 402 may be referred to as an outlet through which the introduced air flows toward the rib 402 to be discharged to the outside. The air passing through the blower fan 50 may be smoothly introduced by preventing an eddy current at the inlet of the bell mouth 70 to improve flow noise. The bell mouth 70 may be provided in various curvatures or shapes so as to form a flow channel through which air flows.

Figure 6:
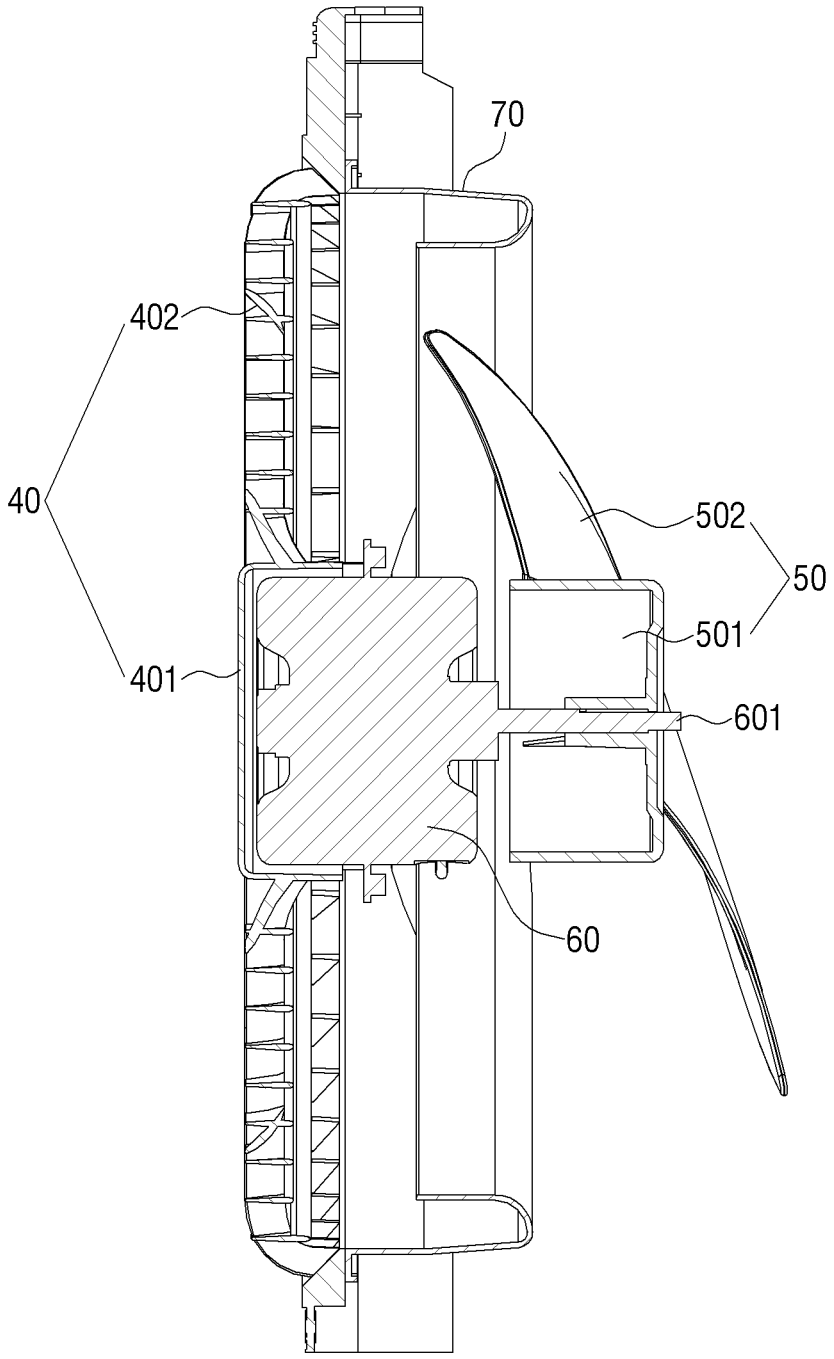
FIG. 6 is a cross-sectional view taken along direction A-A of FIG. 4.
Figure 7:
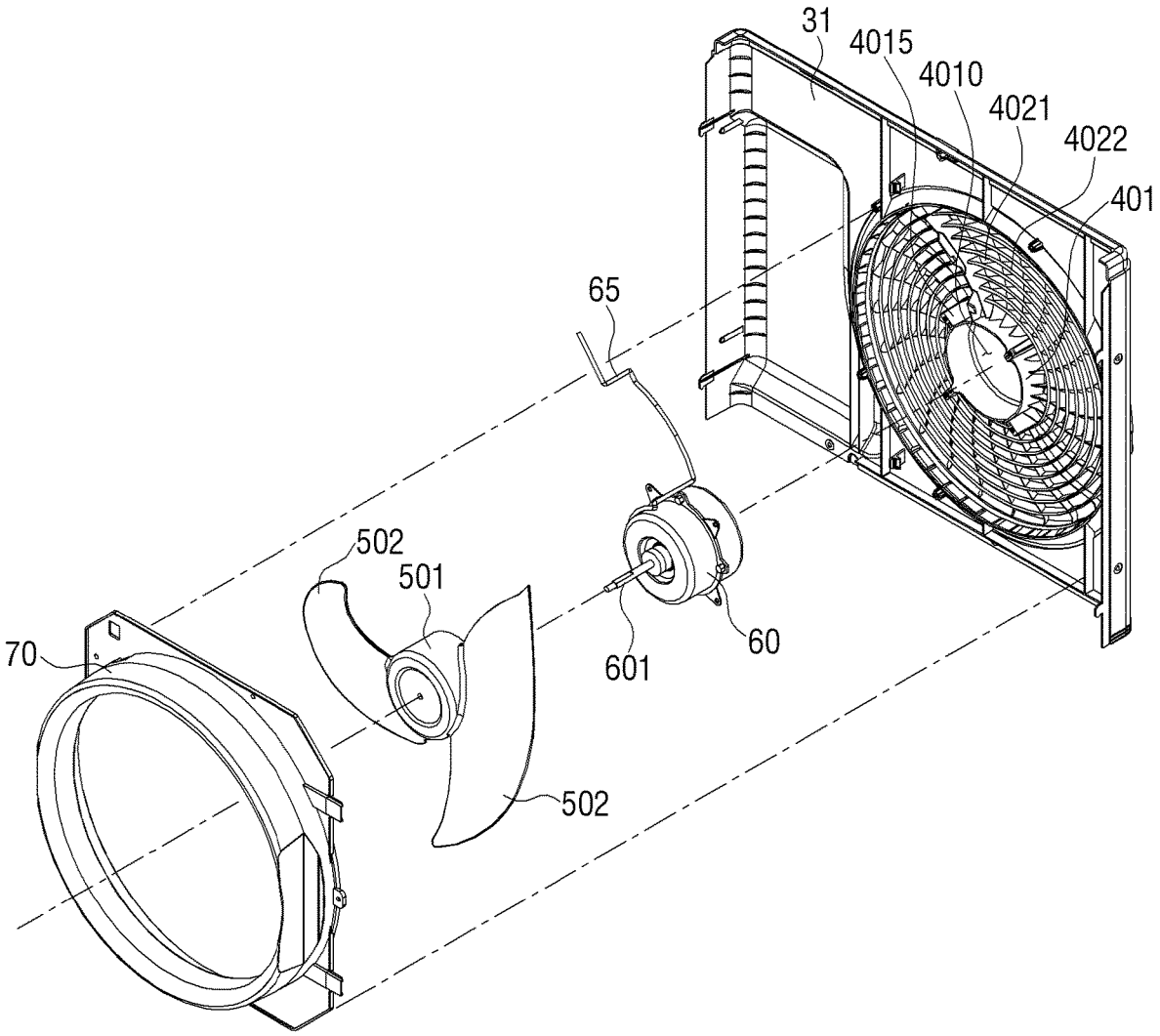
FIG. 7 is an exploded perspective view of the fan guard assembly according to the exemplary embodiment of the present disclosure.

FIG. 6 is a cross-sectional view taken along direction A-A of FIG. 4 and FIG. 7 is an exploded perspective view of the fan guard assembly according to the exemplary embodiment of the present disclosure. The operation of the outdoor unit will be described with reference to FIGS. 6 and 7, focusing on differences from the existing outdoor unit.

Referring to FIGS. 6 and 7, an insertion groove 4010 having a predetermined depth is provided on a rear surface of the hub 401 to insert the motor 60 into the insertion groove 4010 and fix the motor 60 thereto. For example, the hub 401 may have a fastening portion 4015 protruding from the outer circumferential surface, and the motor 60 may be screwed to a fastening hole (not illustrated) formed in the fastening portion 4015. That is, the motor 60 may be firmly fixed to the fastening portion 4015 in a state where the motor 60 is inserted into the insertion groove 4010 at a predetermined depth to be stably supported.

At least a part of the motor 60 is inserted into the insertion groove 4010 of the hub 401. The rib 401 is connected to the hub 401 and the front panel 31, respectively, and thus the hub 401 located at the outlet 33 is stably supported on the front panel 31. In particular, the rib 402 may have enough rigidity to withstand a weight of the motor 60 and the blower fan 50.

For example, in the operation process of the air conditioner, if the compressor is driven, the refrigerant is compressed under a high temperature and a high pressure while passing through the compressor and is transferred to a heat exchanger serving as the condenser. At the same time, the blower fan 50 rotates by driving the motor 60, and outdoor air is introduced into the cabinet 30 through the inlet formed on the side surface or the rear surface of the cabinet 30.

The air introduced into the cabinet 30 is compressed under a high temperature and a high pressure while passing through the heat exchanger to cool the refrigerant flowing into the heat exchanger.

The air passing through the heat exchanger is transferred to the bell mouth 70 through the blower fan 50 and the blower fan 50 is located inside the bell mouth 70. The air inside the cabinet 30 is introduced through the bell mouth 70 and is discharged to the outside.

Conventionally, a separate motor bracket is provided to fix the motor and blower fan to the outdoor unit. The motor bracket is provided between the condenser and the fan in the outdoor unit. In the installation structure, the air introduced into the inlet sequentially passes through the condenser, the motor bracket, and the blower fan and then is discharged through the outlet.

That is, since the motor and the motor bracket are provided at a suction side of the fan, a channel resistance of the suction side of the fan increases, and thus the fan performance may deteriorate. In addition, since the motor bracket needs to have predetermined rigidity to support the motor due to the characteristics of the motor, the motor bracket should be formed as large as possible.

As a result, the motor bracket has a structure to increase the channel resistance, but the fan guard assembly according to the exemplary embodiment of the present disclosure directly fixes the motor 60 to the hub 401 to prevent the blower fan performance from decreasing due to the increase in the channel resistance, thereby effectively decreasing the power consumption of the motor 60 and minimizing the noise.

Figure 8:
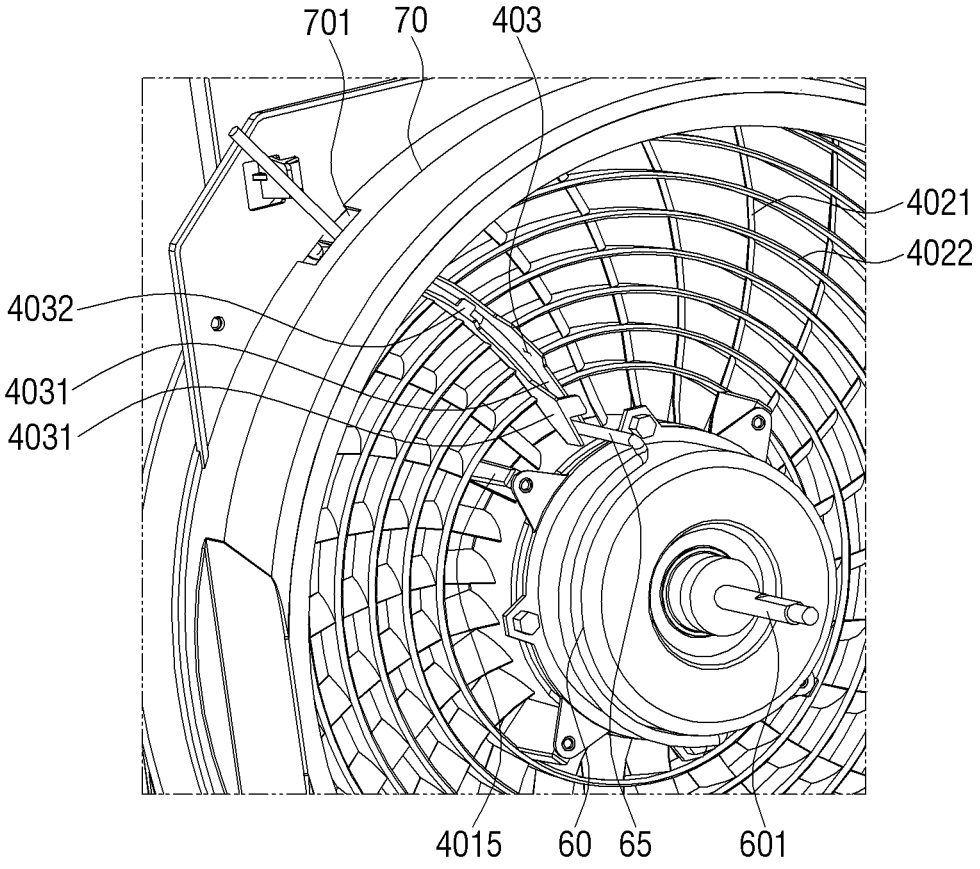
FIG. 8 is an enlarged perspective view for explaining an accommodating portion illustrated in FIG. 7.

FIG. 8 is an enlarged perspective view for explaining an accommodating portion illustrated in FIG. 7. Referring to FIG. 8, the accommodating portion 403 may be provided on the rear surface of at least one first rib 4021 radially located from the hub 401. An electric wire 65 supplying electric power is connected to the motor 60. Here, the electric wire 65 connected to the motor 60 is accommodated in the accommodating portion 403.

For example, protruding portions 4031 may be provided on the rear surface of at least one first rib 4021 to be spaced apart from each other toward the rear. The protruding portion 4031 may have a predetermined height along a longitudinal direction of the first rib 4021 and the accommodating portion 403 may be formed between the respective protrusions 4031. Further, the bell mouth 70 has a through hole 701 to allow the electric wire 65 to pass through.

Further, at least a part of the protruding portion 4031 may be formed with a fixing protrusion 4032 protruding along the circumferential direction. The fixing protrusions 4032 may be provided to be spaced apart from the opposite protrusion 4031 by a predetermined distance. Therefore, the electric wire 65 is stably accommodated in the accommodating portion 403 without being exposed to the blower fan 50 by the fixing protrusion 4032, and may be prevented from being damaged due to the contact with the blower fan 50.

Figure 9:
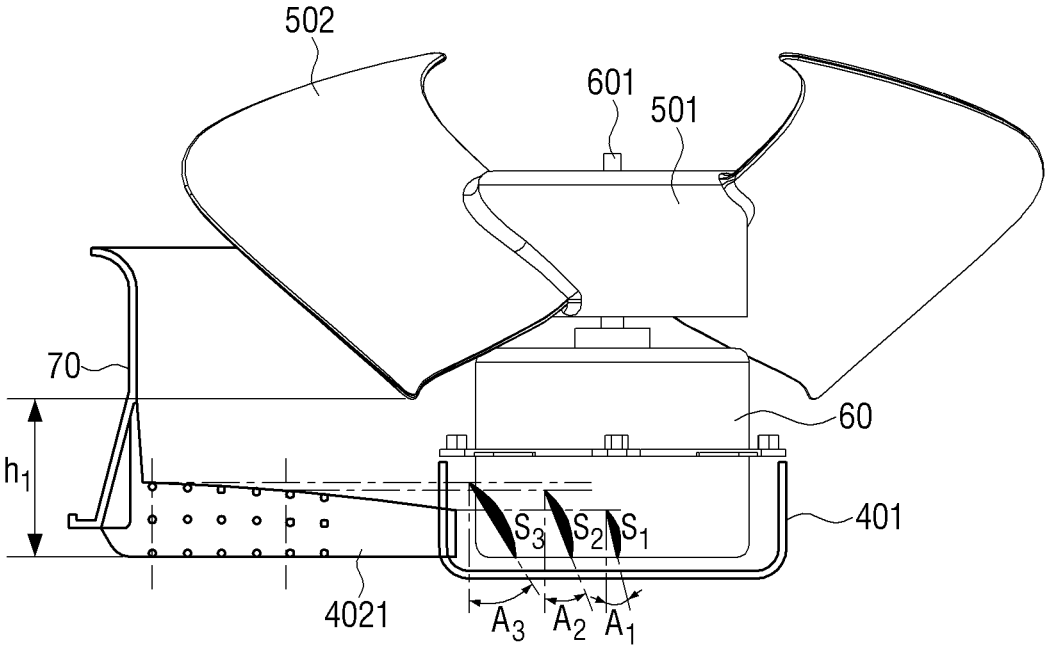
FIGS. 9 and 10 are views for explaining a cross section structure of the fan guard assembly according to the exemplary embodiment of the present disclosure.
Figure 10:
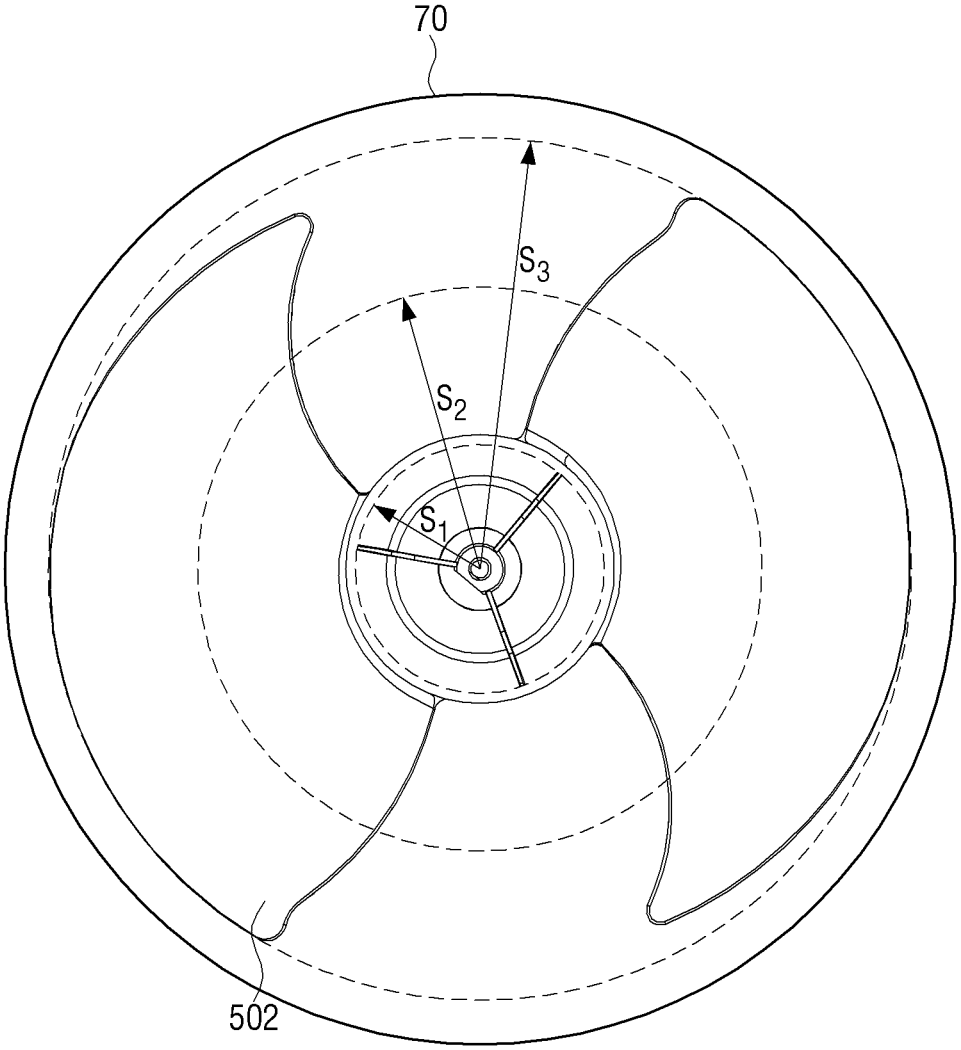

FIGS. 9 and 10 are views for explaining a cross section structure of the fan guard assembly according to the exemplary embodiment of the present disclosure. Referring to FIGS. 9 and 10, the first rib 4021 may be provided to have greater rigidity outwardly so as to easily support the motor 60 and the blower fan 50. A tip of the first rib 4021 may be located on the same plane and a rear end of the first rib 4021 may be shaped to have a height increasing toward the blower fan 50.

For example, the height of the first rib 4021 may be set to have a greater height outwardly with respect to the hub 401. The first rib 4021 has a first end surface $S_1$ corresponding to a position where it is connected to the hub 40, a second end surface $S_3$ corresponding to a tip of a blade 502, and a third end surface $S_2$ located between the first end surface $S_1$ and the second end surface $S_3$, at the same distance from the first end surface $S_1$ and the second end surface $S_3$, respectively.

Here, the first end surface $S_1$ may have a height of 0.02 to 0.09 times the distance L from a center of the hub 401 to the tip of the blade 502. The second end surface $S_3$ may have a height of 0.04 to 0.2 times the distance L from the center of the hub 401 to the tip of the blade 502. The third end surface $S_2$ may have a height of 0.03 to 0.14 times the distance L from the center of the hub 401 to the tip of the blade 502.

Further, the first rib 4021 may be provided so that a tilt angle of a cross section thereof increases as being far away from the hub 401 with respect to a driving shaft 601 of the motor 60. The first end surface $S_1$ may have a tilt angle $A_1$ of 10° to 30° and the second end surface $S_3$ may have a tilt angle $A_3$ of 20° to 40°. In addition, the third end surface $S_2$ may have a tilt angle $A_2$ of 15° to 35°.

In particular, the rigidity for stably supporting the motor 60 and the blower fan 50 may be ensured by providing the height (and number) and the tilt angle of the first rib 4021. Further, it is possible to satisfy the standards on a safety distance $h_1$ (finger safety) between the rib 402 and the blower fan 50 while preventing potential safety accidents that may occur due to the contact of a part (e.g., a finger, etc.) of a user's body with the blower fan 50.

Conventionally, it takes much working process time to mount the motor 60 and the blower fan 50 on the motor bracket that is a separate component, but the fan guard assembly according to the exemplary embodiment of the present disclosure is mounted to directly support the motor 60 to the insertion groove 4010 of the hub 401 to remove the additional working processes, thereby increasing the assembling productivity.

In addition, the tilt angle of the first rib 4021 may be optimized to effectively decrease the noise increasing in proportion to an air volume in the outdoor unit 20 of the air conditioner. In addition, by eliminating the configuration of the motor bracket which is separately installed in the existing outdoor unit, the flow resistance of the air discharged to the outlet may decrease, and as a result noise and power consumption may decrease. Furthermore, the performance of the blower fan 50 may be improved and as a result the miniaturization of the motor 60 may be achieved.

Hereinabove, various exemplary embodiments of the present disclosure are individually described, but each exemplary embodiment need not necessarily be implemented alone and therefore the configurations and operations of each exemplary embodiment may also be implemented in combination with at least one other exemplary embodiment.

Although the preferred exemplary embodiments of the present disclosure have been disclosed for illustrative purposes, those skilled in the art will appreciate that various modifications, additions and substitutions are possible, without departing from the scope and spirit of the disclosure as disclosed in the accompanying claims. Accordingly, such modifications, additions and substitutions should also be understood to fall within the scope of the present disclosure.

What is claimed is:

1. An outdoor unit, comprising:

a cabinet;

a bell mouth provided in the cabinet;

a fan guard provided at an outlet of the bell mouth and including a hub having a cup shape with a base of the cup shape forming a center of a front surface of the fan guard and being continuous so that air does not pass through the center, and sides of the cup shape extending from the base so that the cup shape forms an insertion space inside the hub; and a fan motor assembly including a motor that is at least partially inserted into the insertion space and fixed to the hub, wherein the fan guard includes a rib connecting the hub and the cabinet, the fan motor assembly includes a blower fan driven by the motor, a height of the rib increases outwardly from the hub, and the rib includes:

a first surface corresponding to a position where the rib is connected to the hub, and a second surface corresponding to a tip of a blade of the blower fan, wherein the first surface has a height of 0.02 to 0.09 times a distance L from a center of the hub to the tip of the blade, and the second surface has a height of 0.04 to 0.2 times the distance L.

2. The outdoor unit as claimed in claim 1, wherein the rib further includes a third surface located between the first surface and the second surface, at a same distance from the first surface and the second surface, respectively, and the third surface has a height of 0.03 to 0.14 times the distance L.

3. The outdoor unit as claimed in claim 1, wherein a cross section of the rib has an increasing tilt angle as the rib extends from the hub with respect to a driving shaft of the motor.

4. The outdoor unit as claimed in claim 3, wherein the rib includes a first surface corresponding to a position where the rib is connected to the hub, and a second surface corresponding to a tip of a blade of the blower fan, wherein the first surface has a tilt angle of 10° to 30°, and the second surface has a tilt angle of 20° to 40°.

5. The outdoor unit as claimed in claim 4, wherein the rib further includes a third surface located between the first surface and the second surface, at a same distance from the first surface and the second surface, respectively, and the third surface has a tilt angle of 15° to 35°.

6. The outdoor unit as claimed in claim 1, wherein the rib includes:

a plurality of first ribs radially provided from the hub; and a plurality of second ribs spaced from the hub in a circumferential direction connected to the plurality of first ribs.

7. The outdoor unit as claimed in claim 6, wherein the plurality of first ribs include:

a first rib having a height increasing outwardly from the hub; and an auxiliary rib connecting a second rib of the plurality of second ribs and the cabinet.

8. The outdoor unit as claimed in claim 7, wherein a tip of the first rib is located on a plane and a rear end of the first rib has a height increasing from the plane toward the blower fan.

9. The outdoor unit as claimed in claim 7, wherein a transverse section of the first rib has a fan blade shape or an airfoil shape.

10. The outdoor unit as claimed in claim 1, wherein the hub has a fastening portion protruding from an outer circumferential surface of the hub, and the fastening portion has a fastening hole to fasten the motor to the hub, and thereby fix the motor to the hub.

11. The outdoor unit as claimed in claim 1, wherein the rib has an accommodating portion accommodating an electric wire connected to the motor.

12. The outdoor unit as claimed in claim 11, wherein the bell mouth has a through hole through which the electric wire penetrates.

13. A fan guard assembly, comprising:

a front panel having an outlet; and a fan guard including a hub having a cup shape with a base of the cup shape forming a center of a front surface of the fan guard at a center of the outlet and being continuous so that air does not pass through the center of the front surface, and sides of the cup shape extending from the base so that the cup shape forms an insertion space into which a motor of a fan motor assembly is at least partially insertable and, while at least partially inserted into the hub, is fixable to the hub, and a rib connecting the hub and the front panel, wherein a height of the rib increases outwardly from the hub, and the rib includes:

a first surface corresponding to a position where the rib is connected to the hub, and a second surface corresponding to a tip of a blade of a blower fan driven by the motor, wherein the first surface has a height of 0.02 to 0.09 times a distance L from a center of the hub to the tip of the blade, and the second surface has a height of 0.04 to 0.2 times the distance L.

14. The fan guard assembly as claimed in claim 13, wherein the fan guard has greater rigidity at a radially outward portion as compared to a rigidity at the hub to support the fan motor assembly.

15. The fan guard assembly as claimed in claim 13, wherein the front panel and the fan guard are integrally formed.

* * * * *